United States Patent [19]

Kohl

[11] 4,412,429

[45] Nov. 1, 1983

[54] ICE CUBE MAKING

[75] Inventor: Vance L. Kohl, New Hope, Minn.

[73] Assignee: McQuay Inc., Minneapolis, Minn.

[21] Appl. No.: 325,200

[22] Filed: Nov. 27, 1981

[51] Int. Cl.[3] ..... F25C 1/04

[52] U.S. Cl. ..... 62/347; 62/349

[58] Field of Search ..... 62/349, 73, 71, 347, 62/348, 82

[56] References Cited

U.S. PATENT DOCUMENTS

| | | | |
|---|---|---|---|
| 2,656,686 | 10/1953 | Bayston . | |
| 2,677,249 | 5/1954 | Mason . | |
| 2,723,536 | 11/1955 | Mason . | |
| 2,729,070 | 1/1956 | Ames . | |
| 2,743,588 | 5/1956 | Drier | 62/349 X |
| 2,949,019 | 8/1960 | Roberts | 62/349 X |
| 3,046,753 | 7/1962 | Carapico, Jr. . | |
| 3,048,988 | 8/1962 | Nelson | 62/349 X |
| 3,280,585 | 10/1966 | Lowe . | |
| 3,318,106 | 5/1967 | Litman . | |
| 3,430,452 | 3/1969 | Dedricks et al. | 62/347 X |
| 3,618,335 | 11/1971 | Toma | 62/349 |
| 4,006,605 | 2/1977 | Dickson et al. . | |
| 4,137,724 | 2/1979 | Alexander | 62/138 |
| 4,255,941 | 3/1981 | Bouloy | 62/347 |
| 4,344,298 | 8/1982 | Biemiller | 62/347 |

*Primary Examiner*—William E. Tapolcai

*Attorney, Agent, or Firm*—Merchant, Gould, Smith, Edell, Welter & Schmidt

[57] ABSTRACT

An ice cube making apparatus and method characterized by minimum excess meltage of the ice and minimum energy usage is disclosed. According to the apparatus a plurality of generally flat metalic tubes and interconnecting return bends form a serpentine evaporator path. A jacket member encloses the evaporator member to provide ice cube forming sites on both sides thereof. The jacket has internal passageways and external sites cooled by the evaporator member for forming ice cubes and includes a plurality of intersecting ridge portions whose inner surfaces form portions of the internal passageways and whose outer surfaces form the side walls for the sites for forming the ice cubes. The jacket may be made of flexible plastic material so that the filling of the jacket with water during a harvest mode causes flexing thereof to help to dislodge the ice cubes. Alternatively, the jacket is constructed of a pair of rigid plastic members which may be sandwiched together with the evaporator member inside. According to the method, a flow of water is provided across the freezing sites with the run off water collected and recirculated. During the harvest mode tap water may be provided to the internal passageways of the jacket member to uniformally warm the ice cubes and free them from the jacket, and in the case where the jacket is made of flexible plastic material it may flex to help dislodge the ice cubes. In addition, the compressor is stopped and refrigerant pressure is equalized thereacross to provide relatively warm refrigerant fluid to the evaporator member to aid harvesting.

12 Claims, 18 Drawing Figures

110
150
150a
150b
151a
151b
152
153
154
155
156
157a
157b
158a
159a
159b
160a
130
131
132
133
173
174
177
180
181
182
191
192
193
194
195
196
11
12
13
14
15

ICE CUBE MAKING

FIELD OF THE INVENTION

This invention pertains to the field of ice cube making machines, and in particular to an improved energy-efficient apparatus and method for making ice cubes which have an advantageous shape.

BACKGROUND OF THE PRIOR ART

Ice machines are widely used in restaurants and the like for producing ice, in the form of flakes, chips, cubes, etc. for use in beverages and for other uses relating to food and drink service. Ice machines are also used for making ice for retail sale in bags. Generally, these ice machines include an electrical refrigeration apparatus for freezing water supplied to the machine, a means for periodically removing, or "harvesting" ice from the freezing site and a cabinet or bin for storing the frozen ice until it is needed.

The design of the refrigeration section, and in particular the evaporator of the refrigerator, determines the shape of the resulting ice product. In accordance with customary usage in the industry, the term "ice cube" in this patent is intended to include ice particles of any shape, not just those which are geometrically perfect cubes. Thus, all types of squared or rounded-surfaced ice particles are still referred to as "ice cubes".

In a typical ice making apparatus, water is brought in contact with the evaporator tubes of the refrigeration system, or a surface being refrigerated by evaporator tubes, which causes chilling and freezing of the water. Over a period of time the ice layer grows as water continues to freeze to the evaporator surface. Often a secondary surface is included in the evaporator assembly and is shaped to work in conjunction with the evaporator tubes to control the shape of the ice cube as it grows. As freezing continues, the ice cube continues to grow to a particular shape which is dependent upon the geometry of the evaporator tube contact area and secondary surface at the freezing sites. This operation continues for an interval of time, typically fifteen or twenty minutes, until the size of the ice cube is adequate. At that point, the harvesting operation takes place to remove the cubes from the evaporator for storage or packaging.

The most common type of harvesting is hot gas harvesting, whereby high temperature gas exiting the compressor of the refrigeration system is diverted into all or part of the evaporator to heat it. The temperature in the refrigerant tubes rises and causes melting of a layer of previously formed ice in direct contact with the evaporator tubes. Because the ice will not release and drop off until all of its surface in contact with the evaporator surface and any secondary surfaces of the evaporator has melted, a considerable amount of heat must be applied to the evaporator tubes. A considerable amount of ice adjacent the evaporator tube will typically melt away in the time required for the melting and release of the cube at the furthest point of contact between the cube and the secondary surface. During the harvesting, a considerable amount of electrical power is consumed in operating the compressor and in melting ice previously made at the cost of consumed electrical energy.

Another type of harvesting involves flooding a top side of an evaporator structure with hot water, where ice has previously been formed on the bottom side of the evaporator at specific sites thereon by the spraying of water into contact with the evaporator. A considerable amount of energy is consumed in the heating of the water, typically to 150 degrees, for this method of harvesting.

Because of the increasing cost and scarcity of energy sources, the energy consumption of devices such as ice cube machines is coming under closer scrutiny, and there is a need for increasing efficiency, i.e. reducing energy consumption, in such devices.

Another problem encountered in prior art ice making machines involve the shape of the finished ice cube product. It has been found that ice cubes having large flat surfaces, such as rectangular or cube shaped ice cubes tend to become frozen together in large masses when stored in a bin or a retailing package. Curved ice cubes reduce the contact area with adjacent cubes and minimize the problem of freezing together during storage, but unfortunately the curved surface ice cubes produced by prior machines tend to have a cylindrical or pillow shape, with concave openings or surfaces which have a tendency of redirecting and reversing the direction of a stream of poured beverage, resulting in spraying or splattering.

SUMMARY OF THE INVENTION

According to one aspect of this invention, an improved ice cube making apparatus and method are provided in which the harvesting operation provides minimum excess meltage of the ice and minimum energy usage. This is achieved in the preferred embodiment by providing a jacket around the evaporator having intersecting ridges which define an array of sites for growing the ice cubes, with the "bottom" of each site being in close contact with an area of evaporator tube for freezing water applied thereto. During harvesting, water is circulated through the jacket to uniformly melt and loosen the cube so they may fall away. There is no need to initially heat the water used for harvesting: tap water is sufficient. The water circulated through the jacket during the harvesting operation is chilled by the ice, and is preferably used as the freezing water for the next cycle, thus providing even greater energy utilization.

According to another aspect of the invention, the cubes formed have somewhat slanted or gently convexed curved surfaces to both minimize mass contact and freezing problems, and fluid stream spraying problems referred to above.

DETAILED DESCRIPTION OF THE PREFERRED EMBODIMENT

Figure 1:
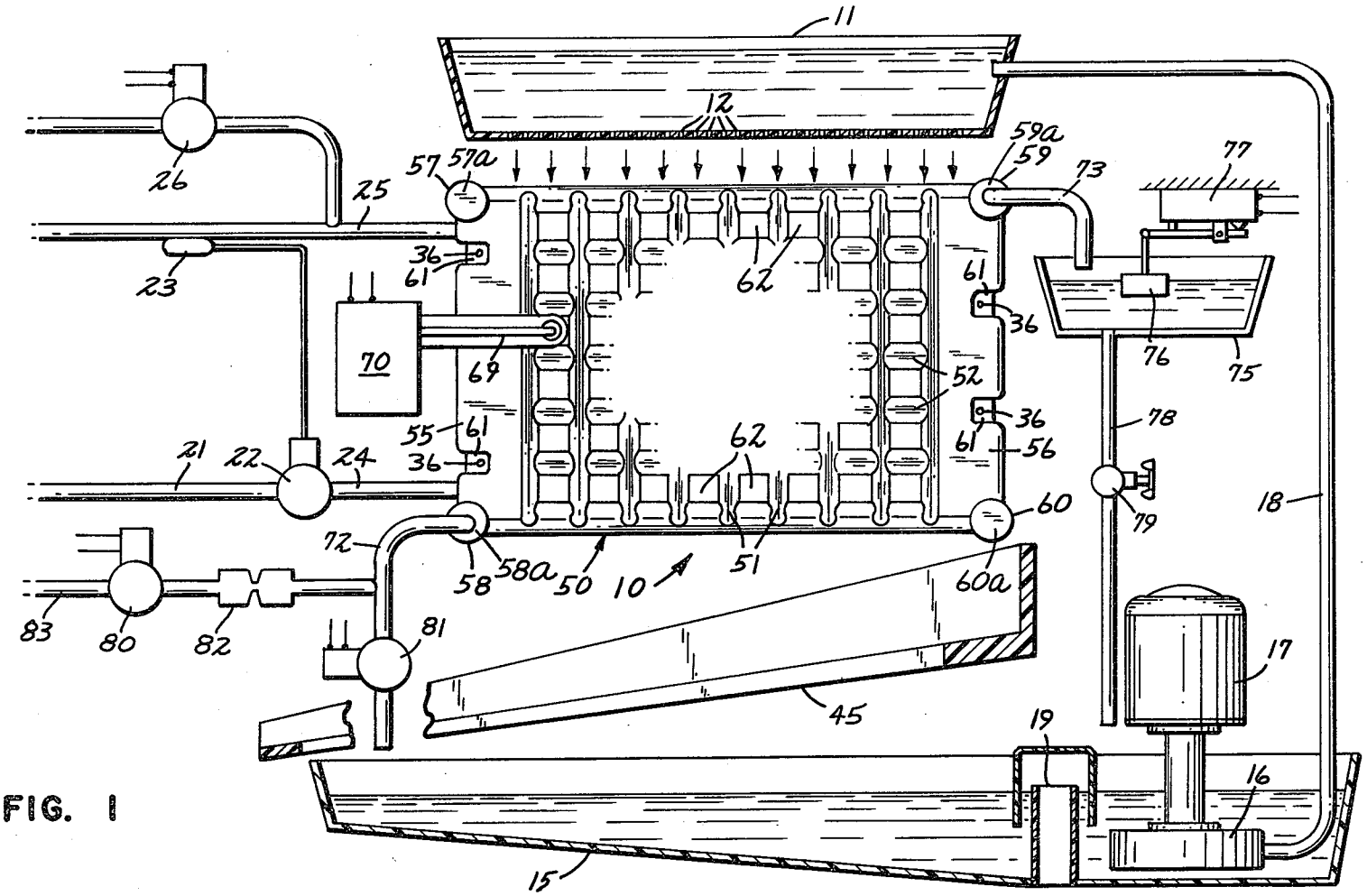
FIG. 1 is a diagrammatic view of an ice cube making apparatus according to the present invention.
Figure 2:
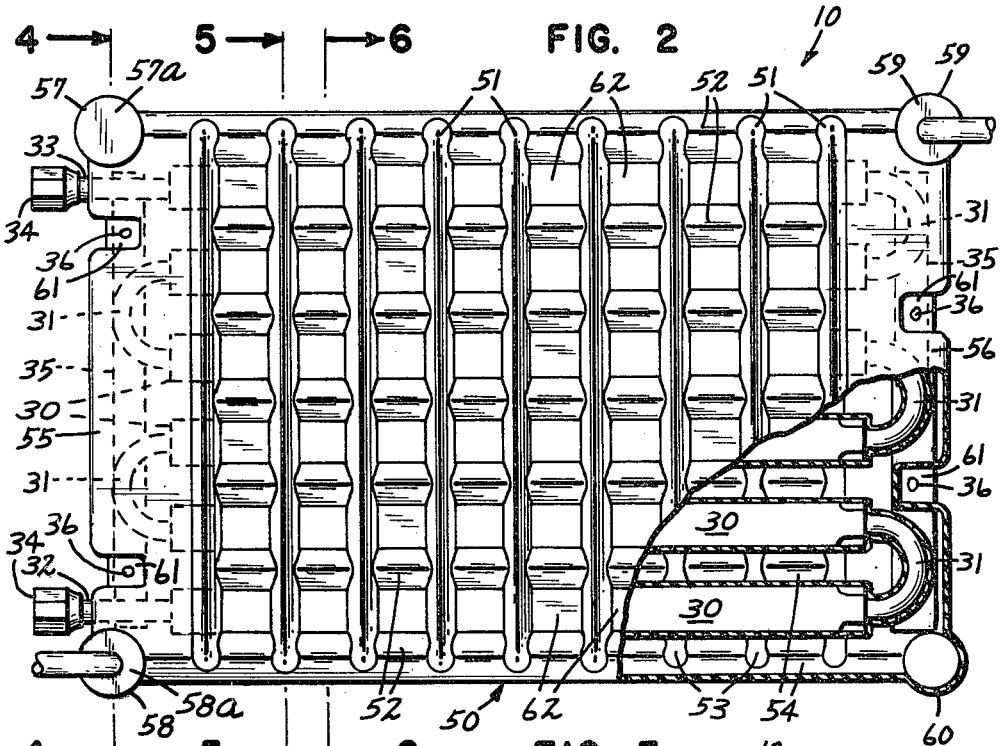
FIG. 2 is an evaporator unit according to one embodiment of the invention for use in the ice making apparatus of FIG. 1, on an enlarged scale with portions thereof broken away for clarity.
Figure 3:
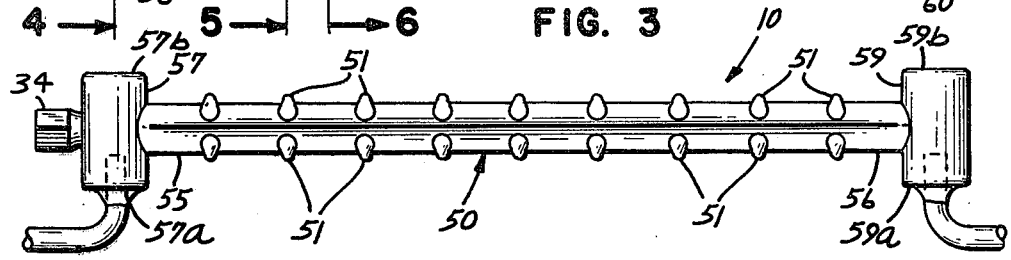
FIG. 3 is a side elevation view of the evaporator assembly of FIG. 2.

In FIG. 1 reference number 10 generally designates the evaporator assembly of an ice making machine according to the present invention. Evaporator assembly 10 is mounted vertically on edge by suitable means (not shown) and water is allowed to trickle down over the surfaces of the evaporator assembly while refrigerant is supplied to evaporator tubes within the assembly. In FIG. 1, reference number 11 is a distributor, which is a trough-like structure for holding water and allowing it to pass through a plurality of small holes 12 spread along its bottom and positioned above the evaporator. Some of the water freezes to form ice on the evaporator surfaces, and the remainder drips off and is collected at sump 15. The collected water is recirculated through pump 16 which is driven by motor 17, and conduit 18 which returns it to distributor 11.

A refrigeration system is provided for supplying refrigerant to evaporator assembly 10 from a compressor and condenser of a refrigeration system (not shown) which may be of any design. Refrigerant from the condenser is applied through conduit 21 to conventional expansion valve 22, and from there through tube 24 to evaporator assembly 10. Evaporated refrigerant exits evaporator assembly 10 through tube 25, which connects to the suction side of the refrigeration system compresser. Sensing bulb 23 is in thermal contact with tube 25, and connects via a capillary tube for control of expansion valve 22 in the conventional manner.

Referring now to FIGS. 2 through 6, an evaporator assembly 10 according to the presently preferred embodiment of the invention is shown. The referigerant path through the evaporator consists of a serpentine path of tubing sections 30 (6 sections in the embodiment shown) which are interconnected to form a refrigerant flow path by means of return bends or elbows 31. For the entrance and exit points for the refrigerant, short tubing sections 32 and 33 are provided. Suitable fittings 34 are provided on these tubes for connection to the other components of the refrigeration path described above with respect to FIG. 1. As an alternative to use of separate tube sections 30 and return bends 31, a single long tubing section can be used and bent back and forth in a serpentine fashion to form the evaporator refrigerant path.

Mechanical support for the evaporator assembly is provided by bar-like support brackets 35, two of which are used, one at either side of the assembly. Support brackets 35 are secured as by brazing or the like to the return bends 31 and tubing sections 32, 33. Mounting holes are formed in the support brackets 35 as at 36 to permit mechanical mounting of the evaporator assembly in an ice making machine.

Figure 17:
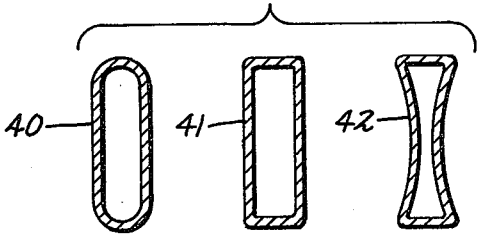
FIG. 17 is a sectional view of three different tube types that can be used in the evaporator assembly of the invention.

Tubing sections 30 can be made of copper, stainless steel or other material having a high heat conductivity, and can take any of a variety of shapes, for example those shown in FIG. 17. In FIG. 17, reference number 40 shows one possible cross section for tube sections 30, having generally flat sides and rounded edges. Reference 41 shows a rectangular section tubing which may also be used. FIG. 42 shows another tube cross section shape that can be used, and which would have the advantage of allowing thinner walled tubing because the concave shape of the sides gives added strength. The concave shape of the sides may also be advantageous in terms of the shape of the ice cube product made by the apparatus, by providing a more convex shape to a portion of the cube.

Referring again to FIGS. 2 through 6, the jacket 50 for the evaporator will now be described. Generally speaking, jacket 50 consists, in the embodiment of FIGS. 2 through 6, of a flexible thermoplastic jacket which totally encloses the evaporator tubes and which provides passageways for circulation of water within the jacket. Jacket 50 includes a set of spaced parallel vertical ridge portions 51 on both sides of the evaporator assembly. These ridge portions define water passageways 53 therein. Jacket 50 also includes a plurality of spaced parallel horizontal ridges 52 on both sides of the evaporator. Ridges 52 and 51 intersect in a grid-like array. Horizontal ridges 52 contain water passageways 54. Horizontal passageways 54 and vertical passageways 53 are open internally of the jacket, i.e. merge or interconnect each junction of a vertical ridge 51 and horizontal ridge 52, on both sides of the evaporator, so as to create grid work of intersecting passageways through which water can freely circulate internally of the jacket.

In addition to defining water passageways on their inside surfaces, ridges 51 and 52 also serve as partitions to define cells 62 which are the sites at which the ice cubes are grown. An array of cells 62 is provided on both sides of evaporator assembly 10, each cell 62 being bounded by a pair of adjacent vertical ridges 51 and a pair of adjacent horizontal ridges 52. The bottom of the cell consists of a floor portion 63 which is a thin layer of plastic material directly on the sidewall of a tube section 30.

Jacket 50 also includes end manifold portions 55 and 56, which cover the return bend sections of the evaporator tubing, but which do not have ice cube cells. The end manifold portions are indented at 61 to expose portions of support brackets 35 adjacent mounting holes 36, to permit attachment and mounting of the evaporator. Manifold portions 55 and 56 provide mixing and distribution areas for water internally of the jacket prior to and after distribution and travelling through the various internal passageways in the central, ice-making portions of the evaporator assembly. Manifold portion 55 includes boss portions 57 and 58, and similarly manifold portion 56 includes boss portions 59 and 60, positioned at the corners thereof and formed intergrally with the jacket. Each boss portion has two ends, ends 57*a*, 58*a*, 59*a*, and 60*a* showing in the side visible in FIG. 2, with sides 57*b*-60*b* on the opposite side. Some, but not all, of these bosses are used for connection to water supply and return lines as explained further below, for supplying water to the interior of jacket 50.

The flexible jacket evaporator embodiment of FIGS. 2 through 6 is preferably made by a rotational molding process. First the evaporator serpentine is formed, either by bending a single tube, or by brazing or otherwise securing return bends and tube sections as in FIG. 2. Support brackets 35 are also secured in place. The tube serpentine assembly is then coated with a primer so the vinyl will adhere to it. The serpentine is placed in a mold which is configured to form the vertical and horizontal ridge portions, manifold portions, etc. It is preferable to precoat the surfaces of the tubing sections with liquid vinyl material to get good coverage on them. The liquid vinyl material is then placed in the mold, either before or after closing the mold. The mold is spun or rotated and heated, to spread the material around within the mold and cure it to form the jacket previously described with reference to FIGS. 2 through 6.

If the precoating of the surfaces of the tubing sections is omitted, there is a possibility that the vinyl material will not spread well enough to cover them, creating voids. In the case of copper tubing, applicable sanitary code regulations require that the copper be covered so that it will not contact the water used to make the ice, so complete coating of the copper tubes at the bottoms of the cells is important for this reason also. However, for maximum heat transfer purposes, the thickness of the plastic covering at the bottom of the cell should be very thin. In the preferred embodiment the thickness of the jacket material in this region is about 1/1000th of an inch, whereas the thickness of the jacket in other regions is from 10 to 60/1000ths of an inch.

In the embodiment of FIG. 1, conduit 72 connects through a suitable opening cut in boss 58*a* to supply water to the interior of the jacket. Of course the opening is sealed around conduit 72 to prevent leakage. Conduit 73 similarly connects to boss 59*a*. In the embodiment shown, bosses 57 and 60 are not used and therefore no openings are cut in them. Conduit 73 is positioned to drain into a reservoir 75. Reservoir 75 has a float 76 linked to a float switch 77. An outlet from the bottom of reservoir 75 connects through conduit or pipe 78 through a restricter valve 79 to drain into sump 15.

Water for operating the ice making apparatus can come from an ordinary tap water supply at whatever its normal temperature is; no preheating of water is required. The tap water supply connects to pipe 83 which connects through solenoid valve 80 and restriction device 82 to join conduit 72. A branch of conduit 72 connects through solenoid valve 81 whose outlet is positioned to drain into sump 15.

The operation of the embodiment of FIG. 1 is as follows. At the start of an ice making cycle, valve 80 is closed and valve 81 is opened, so as to drain water out of jacket 50. The refrigeration system is put into operation, supplying refrigerant through expansion valve 22 and pipe 24 to the evaporator, cooling the evaporator tube sections 30. Motor 17 is operated to drive pump 16 to pump water from sump 15 to distributor 11, where the water trickles through openings 12 and streams down across both sides of evaporator assembly 10. The water is generally guided by the vertical partitions or ridges, and flows over across and down the horizontal ridges or partitions. As the water crosses the floor portions 63 of the ice cells 62, it comes in contact with the chilled coated surfaces of the evaporator tube sections 30, causing some of the water to freeze. Water that does not freeze drips off the bottom of the evaporator assembly to sump 15, where it is recirculated by the pump. As the process continues, the ice layer grows in thickness in each cell, forming an ice cube at each cell. The formed ice cube is indicated in broken line 65 in FIG. 6.

After the ice is built up to sufficient thickness, the freezing mode is suspended and the harvest mode is begun. This determination can be based upon time, by a suitable time control, or can be based upon an ice thickness measurement probe 69, as shown in FIG. 1. Temperature probe 69 is mounted by a suitable bracket adjacent but spaced apart from the evaporator. The probe can be a conventional thermostat element or a temperature measurement device such as a thermal element or thermocouple, and also may include a small electrical heater which serves to keep the probe relatively warm, so long as it is in air or hit by occasional water drops. However, when the ice thickness builds out sufficiently to bridge over and contact the temperature probe, the cold of the ice and constant water film running over it overpowers the small heater in the probe, causing the temperature to drop, which is detected by control device 70 which then initiates the harvest cycle. The mounting bracket for probe 69 can be adjustable in its spacing from the evaporator to control ice thickeness.

To harvest the ice, the compressor is stopped and valve 26, in a branch of refrigerant line 25, is opened to equalize refrigerant pressure across the compressor. This allows heat already built up through the condenser to migrate back through the return line into the evaporator, aiding in melting and release of the ice. Equalization of pressure also makes the subsequent compressor startup easier. Valve 81 is closed, and valve 80 is opened to cause water to flow inward through device 82 and conduit 72 to fill the interior of jacket 50. When it is full, water flows out conduit 73 to reservoir 75. The restriction provided by restricter valve 79 limits the rate at which water can flow out of reservoir 75, causing a backup of water within the reservoir. Eventually float 76 actuates switch 77 to close valve 80. As water continues to drain from reservoir 75, the float switch will again cause valve 80 to open to introduce more water, etc. so that a flow of water is maintained circulating through jacket 50, and in particular the vertical and horizontal passageways 53 and 54 thereof.

Figure 6:
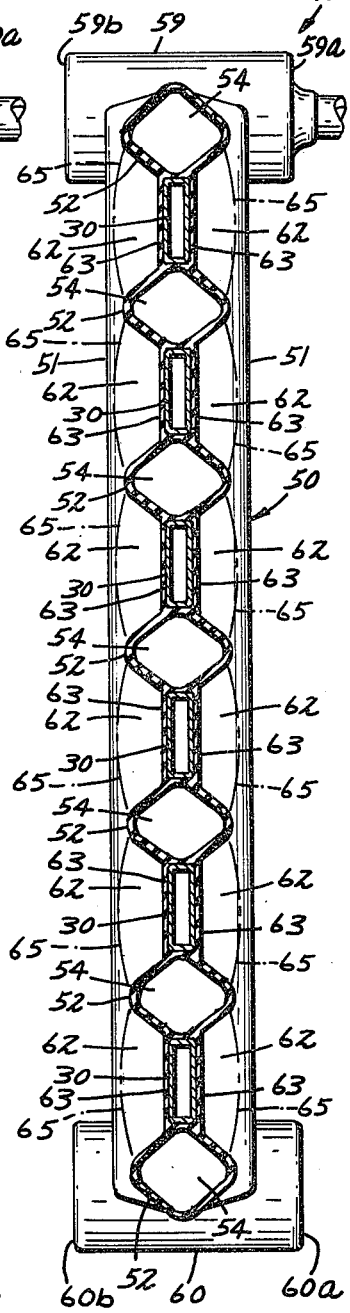
FIG. 6 is a section taken along line 6—6 of FIG. 2, at an enlarged scale.

This circulation of water causes melting of the ice cubes. The water within the jacket surrounds the evaporator tube sections 30, and fills the passageways whose sidewalls are the sides of the cube cells. As can be seen in FIG. 6 the floor portion 63 of the cell and all four sidewalls of contact with the ice cube, which are formed by a pair of vertical and a pair of horizontal partition-passageways, are warmed with the circulating tap water until a thin film of ice in contact with the evaporator jacket melts and the ice cube falls free. It is important to notice that since all parts of the jacket including the partitions and the evaporator tube are brought to the same temperature, the melting of the ice is uniform, so that there is no excess melting of a portion of the ice cube in contact with the evaporator tube while waiting for portions of the ice cube in contact with some other part of the structure away from the evaporator tube melts, as was the case in the prior art. Also, the flexibility of the vinyl water jacket helps in freeing the ice cubes, as the weight of water filling the jacket will result in bulging of the jacket sides.

The ice cubes fall free and are collected by ice collector 45, which is a slanted shelf made of spaced members sized to catch the ice cubes but allow water to pass therethrough to the sump. The ice cubes slide down collect or 45 for receiving in a storage bin or the like (not shown). If desired, depending upon the geometry of the apparatus for mounting the evaporator assembly or assemblies, the water sump and the ice collecting device, one or more splash plates can be positioned adjacent but spaced from the sides of the evaporator assembly to direct water and ice falling off the evaporator assemblies.

During the harvesting process, restriction device 82 and restricter valve 79 determine the rate and amount of water introduced to the system, and these components can be selected for best operation in terms of harvest time and amount of water used for harvest. Restriction device 82 can be a part of valve 80, for simplicity.

It will be appreciated that the water used in jacket 50 for harvesting the ice is chilled by the ice and by the tubes which of course are cold at the beginning of the harvest cycle. The chilling of this water is used to advantage by the system which then uses the jacket water for replenishing the sump water to form ice on the next cycle. Preferably, the flow of water as determined by restriction device 82 and restrictor valve 79 is selected to bring in slightly more water on each harvest cycle than was used for forming ice on the previous ice cycle. The excess water raises the level in sump 15 and passes over spillway pipe 19 to a suitable drain or collector. This ensures a certain amount of mixing or freshing of the water in sump 15, which otherwise would tend to become excessively mineralized due to the freezing action of ice, which leaves dissolved minerals behind.

As an alternate to the water connections shown in FIG. 1, conduit 73 can be directed to miss reservoir 75 and to spill its water directly to return to sump 15. An additional conduit would connect from boss 60 to communicate with the interior of reservoir 75, which would be moved upward so that the water level therein would be placed at approximately the top of the jacket. This reservoir would then act as a sort of standpipe and float switch 76–77 would continue to operate valve 80. As water would drain through valve 79 and the water level in reservoir 75 would drop, the float switch would open valve 80 which would send additional water to the jacket. Because the water level through this additional conduit to the reservoir would lag the water level in the jacket, some excess water would spill off conduit 73, and then float switch 76–77 would turn off valve 80, and this operation would be repeated through the harvesting cycle.

FIGS. 9 through 16 show an alternate embodiment 110 of the evaporator unit of the present invention. In this embodiment, the evaporator serpentine can be substantially identical to that of the embodiment of FIGS. 1–6, except that no mounting bar corresponding to item 35 is required. However, the jacket which surrounds the evaporator is made in a different manner. In the second embodiment, reference number 150 generally refers to the evaporator jacket. It consists of two halves 150*a* and 150*b* which are sandwiched together on either side of, and surrounding evaporator serpentine. The jacket is made of a somewhat more rigid plastic material; rigid in the sense that the half sections are rigid enough to permit assembly of the shell halves together with the system of tongue-and-groove and integral pin and hole connections. Jacket halves 150*a* and 150*b* can be different i.e. complementary in terms of the tongues and grooves and pins and holes. Alternatively, as in the embodiment shown, the two jacket halves can be identical in which case the locations of the pins and holes alternate, and the tongues and grooves reverse from one end of the jacket half to the other, so that two identical jacket halves will mate together by rotating one 180 degrees with respect to the other. In this manner a single mold can produce both jacket halves.

Figure 12:
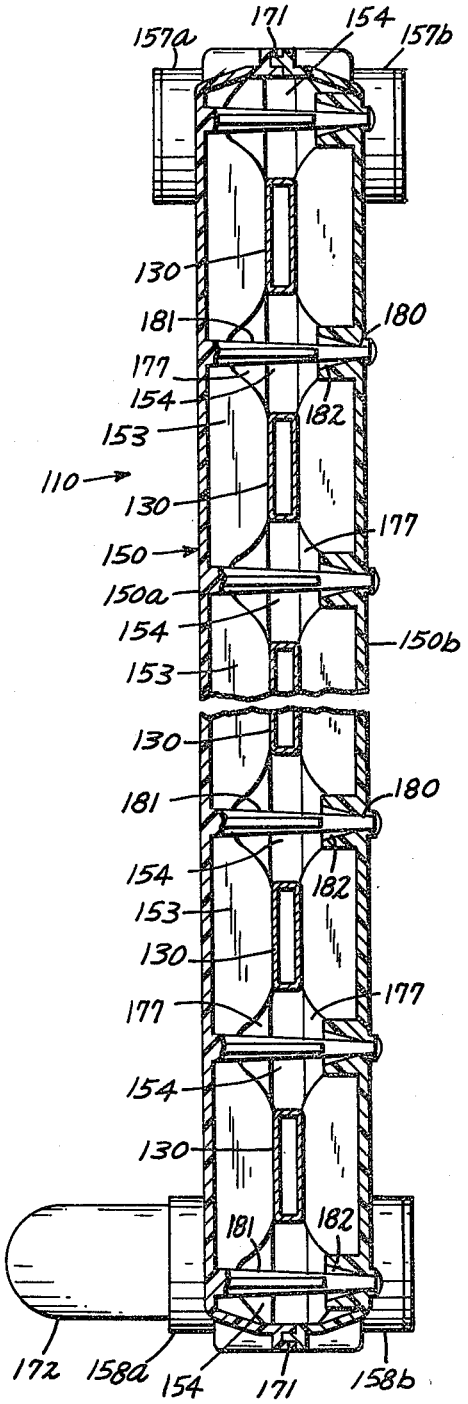
FIG. 12 is a section taken along line 12—12 of FIG. 9, at an enlarged scale.
Figure 13:
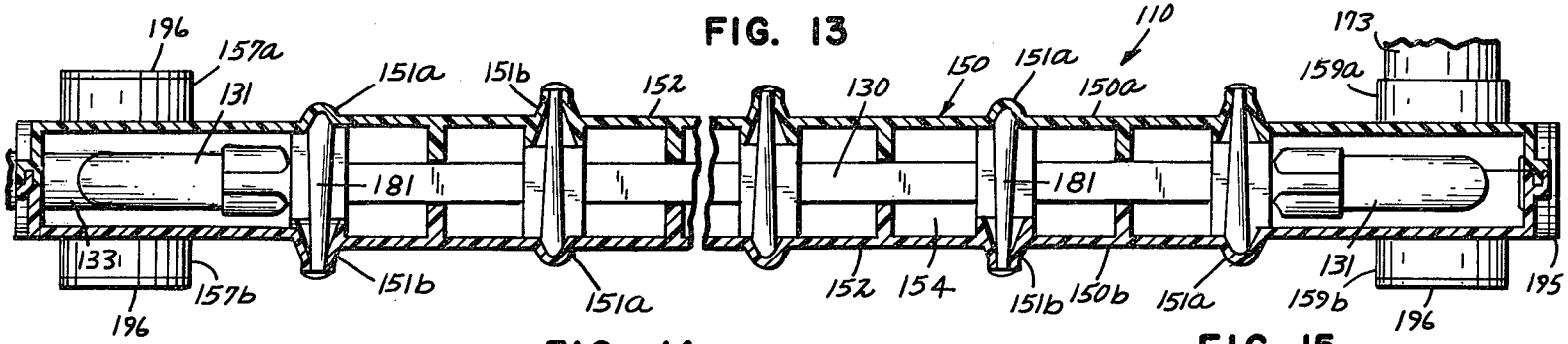
FIG. 13 is a sectional view taken along line 13—13 of FIG. 9, at an enlarged scale.
Figure 14:
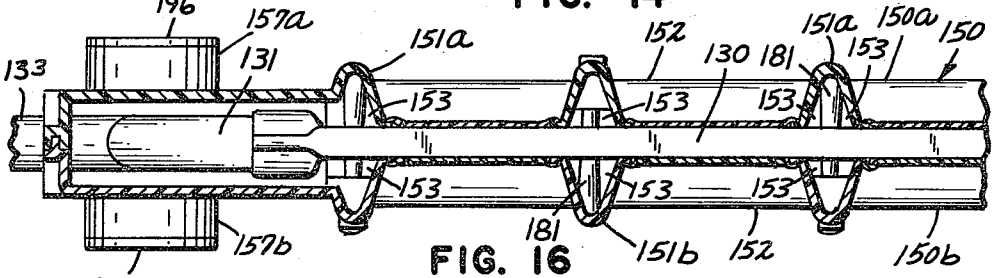
FIG. 14 is a sectional view taken along line 14—14 of FIG. 9, at an enlarged scale.
Figure 15:
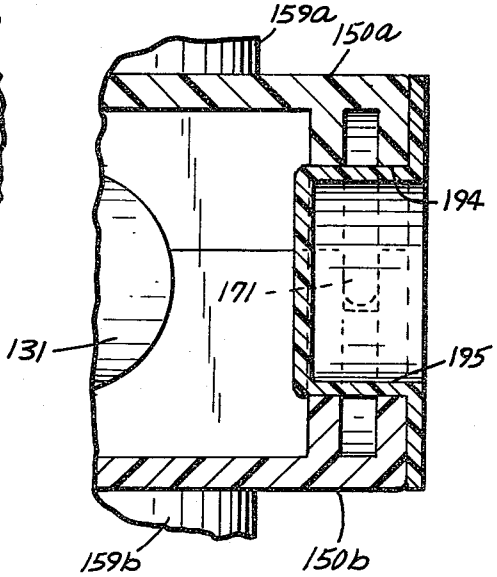
FIG. 15 is a sectional view taken along line 15—15 of FIG. 9, at an enlarged scale which is greater than the scale of FIGS. 11–14.

Jacket 150 is generally similar to jacket 50 of the first embodiment in that it includes a plurality of parallel spaced ridges or partitions 151*a*, 151*b* in a vertical orientation, and a plurality of parallel spaced ridges or partitions 152 in a horizontal orientation, which intersect the vertical ones to define an array of cells 162 which are the sites for the formation of the ice cubes. As in the case of the first embodiment, the vertical and horizontal ridges of the second embodiment provide vertical and horizontal passageways, 153, 154, respectively on the interior of the jacket, so that water can circulate therethrough. For example, vertical passageways 153 are seen in FIG. 14, and horizontal passageways 154 are seen in FIGS. 12 and 13.

Jacket 150 also includes manifold portions 155 and 156 along the edges and these serve the same function as manifold portions 55 and 56 of the first embodiment. Jacket 150 of the second embodiment also includes boss portions 157*a* through 160*a* and 157*b* through 160*b*, which correspond to the bosses provided in jacket 50 of the first embodiment.

Figures 9, 10:
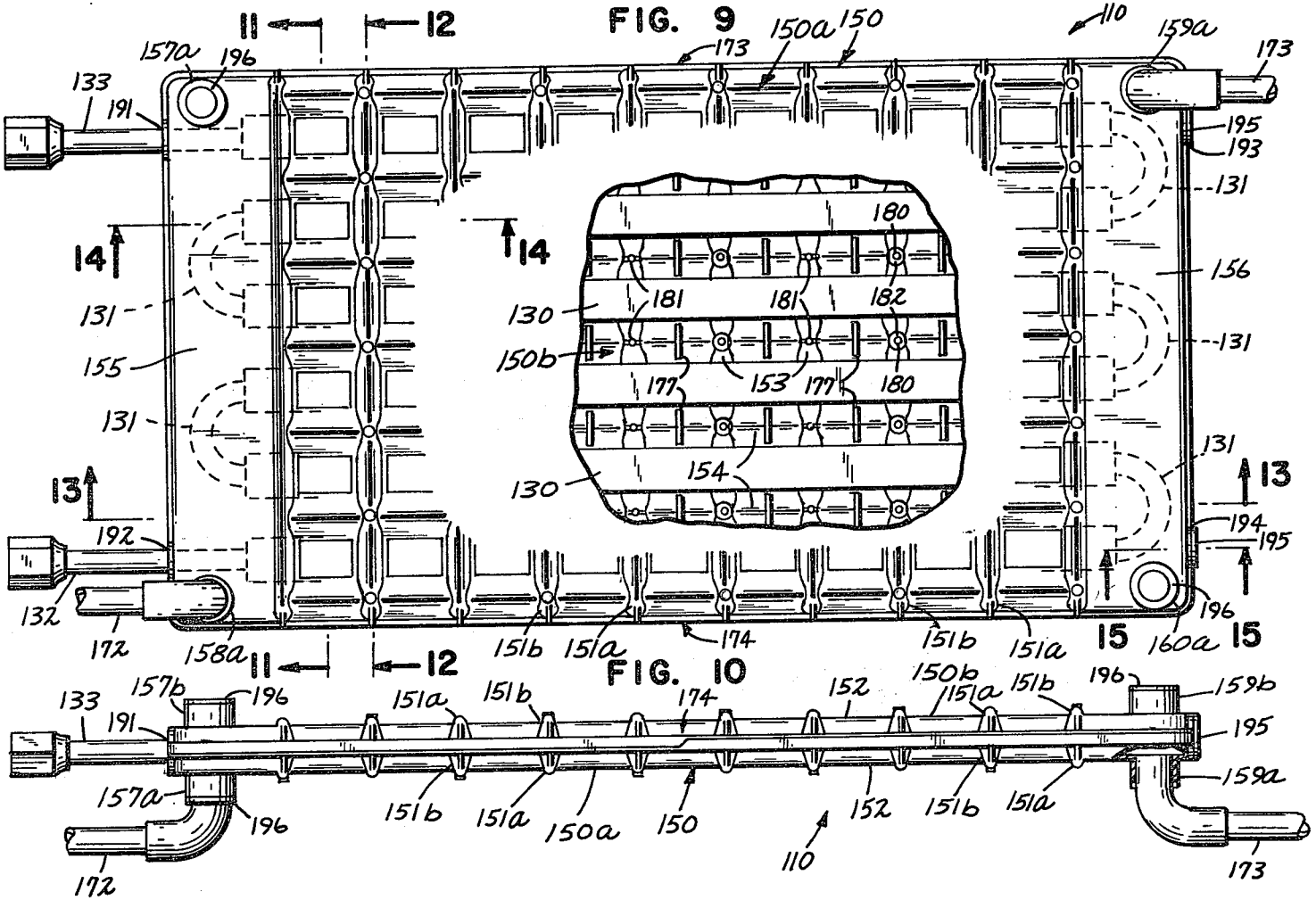
FIG. 9 is a view similar to FIG. 2 showing an alternate embodiment of an evaporator unit according to the present invention.
FIG. 10 is an edge view of the evaporator unit of FIG. 9 as seen from the top thereof.
Figure 16:
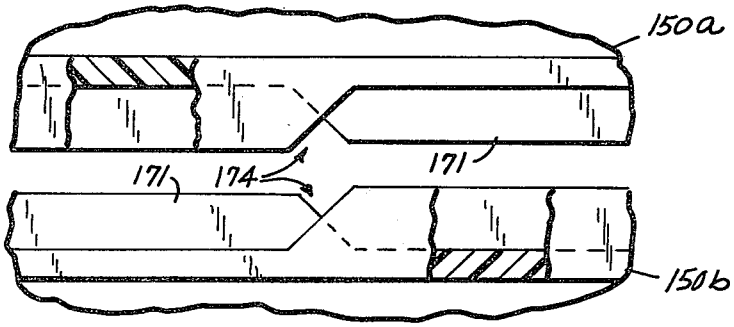
FIG. 16 is a detailed elevational view of the center portion of FIG. 10, at an enlarged scale.

Jacket 150 differs from jacket 50 in that it is formed in two halves, and of course are means provided for joining and sealing the two halves. A tongue-and-groove is provided around the periphery of the halves where they join together. Specifically, since the two halves 150*a*, 150*b* are identical, a tongue 171 is provided around half the periphery, and the corresponding groove is formed around the other half of the periphery so that the two halves will mate together. The transition from tongue to groove occurs at points 173 and 174, on opposing edges of the jacket halves. The transition point is indicated in FIGS. 9, 10 and 16. The tongue-and-groove is seen also in FIGS. 10–14 and 16.

Figure 11:
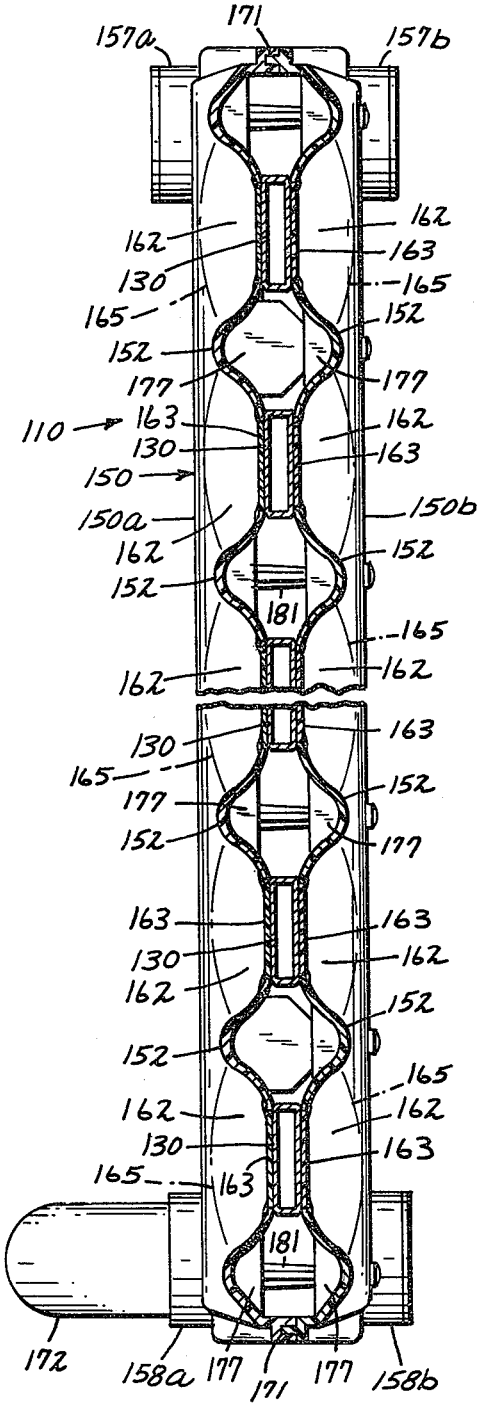
FIG. 11 is a section taken along line 11—11 of FIG. 9, at an enlarged scale.

Integral pins and holes are also used for holding the two jacket halves 150*a*, 150*b* together. Pins are formed intergrally with the jacket halves, on the interior sides thereof. Pins and holes are formed along alternate ones of vertical ridges 151*a* and 151*b*. For example, as seen in FIG. 9, vertical ridges 151*a* have pins formed therein at each intersection thereof with a horizontal ridge 152. Other vertical ridges, indicated as 151*b*, which alternate with ridges 151*a*, contain corresponding holes through which pins from the other side will project when the two jacket halves are brought together. This is also seen in FIGS. 11, 12 and 13. The pins are indicated by reference number 181, and the holes are indicated by reference number 180. On the interior side of the jacket halves, each hole includes a cone shaped socket 182 which serves to guide the pins to the holes when the two halves are assembled.

Holes 191 and 192 are provided for receiving pipes 133 and 132, respectively for connection of the evaporator to the refrigeration system. At the opposite edge of the evaporator adjacent manifold portion 156, a corresponding pair of holes 193 and 194 are provided, due to the technique of making the evaporator from two identical sections. Since these openings are not needed, plugs 195 are inserted, as seen also in the fragmentary detail view of FIG. 15. Similar plugs 196 are provided for the unused bosses. Suitable webs 177 are provided in the interior of horizontal ridges 152, generally transverse thereof, for reinforcing and strengthening the edges of the ridge near their point of contact with the evaporator tube sections 130.

Each of the pins 181 is provided with a pair of flange or wing portions, the ends of which abut sockets 182 of the mating holes to serve as a stop to limit the positioning of the two jacket halves as they are brought together during assembly.

In making the embodiment of FIGS. 9–16, the jacket halves are injection molded plastic parts. The evaporator serpentine can be substantially as in the first embodiment. One method of assembly would use either tin plated copper evaporator tubes, or stainless steel evaporator tubes, which would be in contact with the water. The serpentine would be laid in position in one jacket half, and the other would be placed over the serpentine and onto the first jacket half so that the pins engage the holes and tongues engage grooves. They would then be squeezed together until the stop flanges on the pins engage the sockets. The ends of the pins which protrude through the holes can then be flattened with a hot iron or solvent glued to hold the assembly together. The evaporator tubes would be exposed to the ice-forming water at the bottom of each cell, and for that reason plated copper or stainless steel would have to be used to comply with applicable sanitation regulations.

The presently preferred method of assembly permits the use of unplated copper evaporator tubes. The tubes would first be coated with a suitable adhesive, for example epoxy. The serpentine would then be placed in one jacket half and the other one assembled as described above. The adhesive would serve the purpose of coating the copper tubes, sealing to the jacket around the ice-forming sites to prevent any water leakage from the jacket, and also helping to hold the assembly together.

In use, the embodiment of FIGS. 9–16 would be placed in a system as in FIG. 1, and would operate in the same manner.

Figure 18:
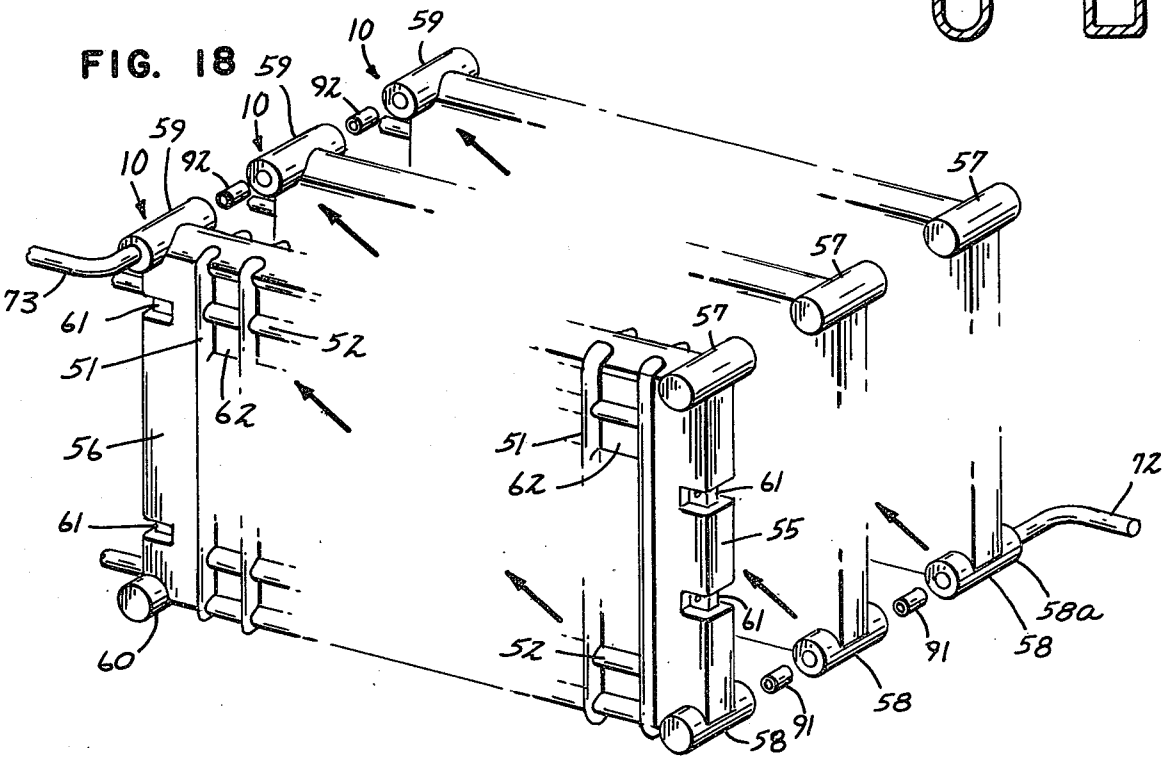
FIG. 18 is a view illustrating the use of a plurality of evaporator assemblies in an ice making apparatus.

FIG. 18 shows, in somewhat diagrammatic form, the manner in which a plurality of evaporator assemblies can be used in parallel to make an ice making machine of the desired capacity. In FIG. 18, three different evaporator assemblies 10 are positioned on edge in parallel, but spaced orientation. Although three are shown, it will be appreciated that any number can be provided, and the cabinet or housing which holds the entire apparatus would be correspondingly sized. Water supply conduit 72 connects to boss 58*a* of one of the evaporator assemblies. Connector pipes 91 are positioned between the bosses 58 of adjacent evaporator assemblies 10, and connect thereto to provide a water distribution manifold for all of the evaporator assemblies. FIG. 18 is an exploded view that shows connector pipes 91 spaced apart from the bosses, but it will be understood that in use they will connect to the bosses.

Similarly, connector pipes 92 connect bosses 59 of the adjacent evaporator assemblies so that a common manifold is formed, connecting to conduit 73 for the water jacket.

Figure 7:
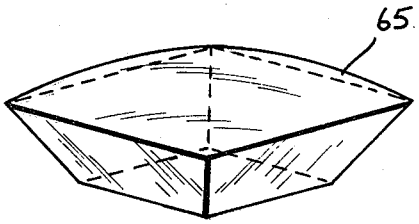
FIGS. 7 and 8 are perspective views at an enlarged scale of typical ice cubes made through the use of the ice making apparatus of FIG. 1.
Figure 8:
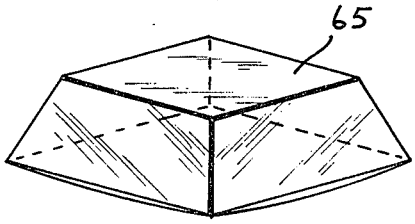
Figure 4:
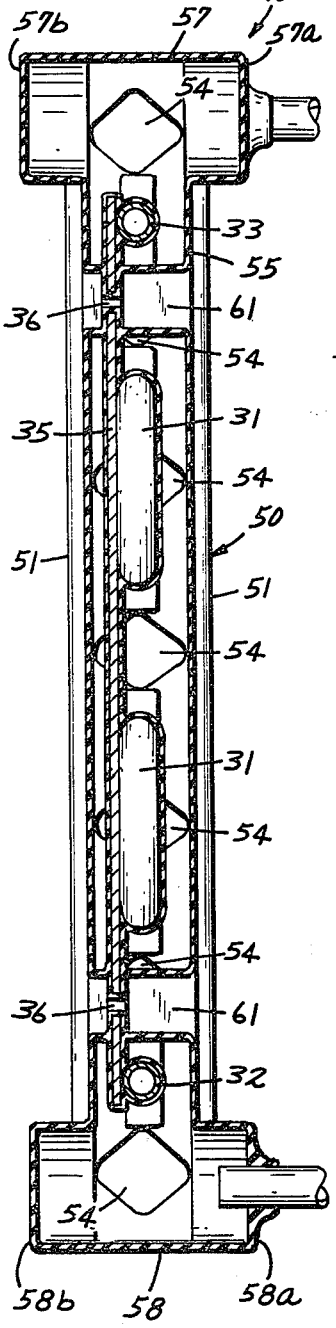
FIG. 4 is a section taken along line 4—4 of FIG. 2, at an enlarged scale.
Figure 5:
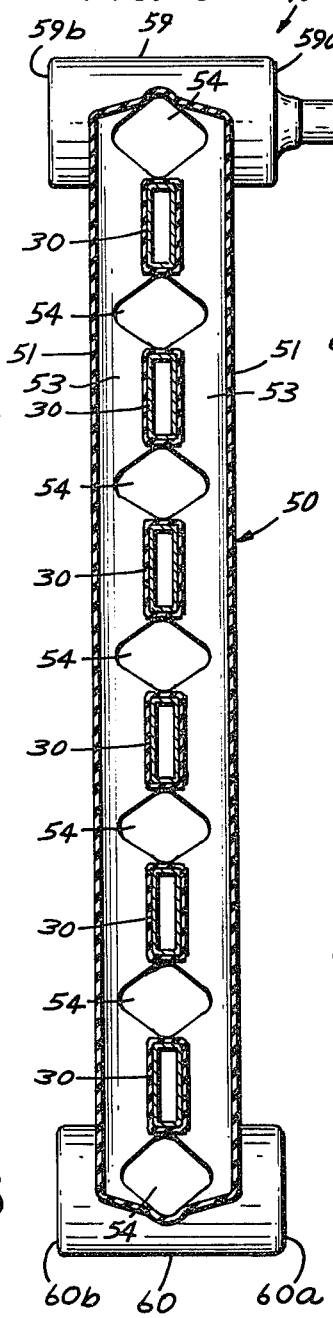
FIG. 5 is a section taken along line 5—5 of FIG. 2, at an enlarged scale.

Referring to FIGS. 7 and 8, ice cube 65 formed by the ice making apparatus of the present invention is shown in two different views. The larger, gently convex surface which forms away from the evaporator assembly is seen, as well as the opposite smaller surface which forms at the bottom of each cell. Also seen are the sloped or angled walls which correspond to contact with the horizontal and vertical ridges that define each cell. In the case of ice made with the second embodiment herein, the sloped walls resulting from contact with horizontal ridges 152 will be somewhat curved due to the shape of these ridges as seen in FIG. 11, for example.

The cube shape shown in FIGS. 7 and 8 has the advantageous properties of minimizing large flat surfaces which cause clumping in mass, and avoiding curved surfaces of the type which redirect and spray beverage poured on them, referred to earlier. However, it will be appreciated that the ice making apparatus of this invention is not limited to the particular shapes shown. By choosing the shape of ridges 51 and 52, any of a number of desired shapes can be achieved.

From the foregoing description and drawings, it will be seen that this invention provides a new and improved method of making ice cubes which minimizes energy loss and excessive melting during harvesting, and which can be designed to provide an advantageous ice cube shape.

What is claimed is:

1. Ice making apparatus, comprising:

an evaporator member having an outer surface and having an inner passageway for conducting refrigerant fluid;

a jacket member at least partially enclosing said evaporator member, said jacket having internal passageways and having external sites cooled by said evaporator member for forming ice cubes or particles and including a plurality of intersecting ridge portions whose inner surfaces form portions of said internal passageways, and whose outer surfaces form the side walls for the sites for forming said ice cubes;

means for supplying cooling refrigerant to said evaporator member and for applying water to the outside of said jacket across said sites in a freezing mode of operation; and means for introducing water into said internal passageways of said jacket during an ice harvest mode of operation to uniformly warm the ice cubes or particles formed on said jacket at said sites to free them from said jacket.

2. Apparatus according to claim 1 wherein the portion of said jacket within said sites bounded by said walls is in close thermal contact with a portion of said evaporator member, for freezing water applied thereto.

3. Apparatus according to claim 1 wherein said jacket is made of flexible plastic material so that filling said jacket with water during said harvest mode causes flexing thereof to help dislodge the ice cubes or particles.

4. Apparatus according to claim 1 further including means for using water chilled within said jacket during a harvest mode for applying to said sites during a subsequent freezing mode.

5. Apparatus according to claim 1 wherein said means for cooling said evaporator includes a refrigeration system comprising a compressor, condenser and expansion valve, and means connecting them in circuit with said evaporator member, and further including means for stopping said compressor and equalizing refrigerant pressure thereacross during said harvest mode.

6. Apparatus according to claim 1 wherein said jacket comprises a plastic jacket formed by rotational molding to encapsulate said evaporator member.

7. Apparatus according to claim 1 wherein said jacket comprises a pair of rigid plastic members sandwiched together with said evaporator member inside.

8. Apparatus according to claim 7 wherein said plastic members include tonge-and-groove and integral post and hole connections for securing the halves together.

9. Apparatus according to claim 1 wherein said means for applying water to said freezing sites comprises means for causing a flow of water across the evaporator-jacket assembly and for collecting and recirculating runoff water.

10. Apparatus according to claim 1 further including a temperature probe positioned adjacent said jacket, and control means responsive to ice contacting said probe for initiating said harvest mode.

11. Apparatus according to claim 1 wherein said evaporator comprises a plurality of generally flattened metallic tubes and interconnecting return bends to form a serpentine evaporator path within said jacket.

12. Apparatus according to claim 11 further including mounting brackets connected to said evaporator serpentine and having at least portions extending outside of said jacket to provide mounting sites for said evaporator and jacket assembly.

* * * * *